US009056656B2

(12) United States Patent
Fields

(10) Patent No.: US 9,056,656 B2
(45) Date of Patent: Jun. 16, 2015

(54) MOORING LOOP

(71) Applicant: Thomas W. Fields, Wadsworth, OH (US)

(72) Inventor: Thomas W. Fields, Wadsworth, OH (US)

( * ) Notice: Subject to any disclaimer, the term of this patent is extended or adjusted under 35 U.S.C. 154(b) by 206 days.

(21) Appl. No.: 13/758,172

(22) Filed: Feb. 4, 2013

(65) Prior Publication Data

US 2013/0139741 A1 Jun. 6, 2013

Related U.S. Application Data

(63) Continuation-in-part of application No. 12/993,740, filed as application No. PCT/US2009/050926 on Jul. 17, 2009, now Pat. No. 8,365,646.

(60) Provisional application No. 61/637,330, filed on Apr. 24, 2012, provisional application No. 61/081,858, filed on Jul. 18, 2008.

(51) Int. Cl.
*D07B 1/02* (2006.01)
*B63B 21/20* (2006.01)
(Continued)

(52) U.S. Cl.
CPC . *B63B 21/20* (2013.01); *D07B 1/04* (2013.01); *B63B 2021/203* (2013.01); *D07B 2201/2009* (2013.01); *D07B 2201/2036* (2013.01); *D07B 2201/2041* (2013.01); *D07B 2201/209* (2013.01); *D07B 2401/2005* (2013.01); *D07B 2501/2061* (2013.01); *D07B 1/14* (2013.01);
(Continued)

(58) Field of Classification Search
CPC ..... D07B 1/02; D07B 1/04; D07B 1/14; B63B 21/20
USPC ..... 87/2, 6, 13; 57/21, 201, 210, 238, 244
See application file for complete search history.

(56) References Cited

U.S. PATENT DOCUMENTS 2,441,209 A 5/1948 Rose
3,888,965 A 6/1975 Kwolek
(Continued)

FOREIGN PATENT DOCUMENTS

GB 2111012 A 6/1983
JP 07-216769 A 8/1995

OTHER PUBLICATIONS

International Searching Authority, ISA/KR; "Notification of Transmittal of the International Search Report and the Written Opinion of the International Searching Authority, or the Declaration" For International PCT App. No. PCT/US2013/037614, dated Aug. 20, 2013.

*Primary Examiner* — Shaun R Hurley
(74) *Attorney, Agent, or Firm* — Walker & Jocke

(57) ABSTRACT

A mooring loop is provided for use with connecting a mooring line to a bollard. The mooring loop may stretch and function as a time delay fuse when excessive loads are applied to the mooring line. The mooring loop is comprised of a reactive fiber component in the shape of a continuous loop that includes a plurality of at least one of: an undrawn hydrophobic polymer fiber or a substantially undrawn hydrophobic polymer fiber. At least two jackets are in surrounding relation to portions of the reactive fiber component. The at least two jackets include respective end portions which overlap. As the mooring loop stretches, a visual indicator on an end portion of one of the jackets pulls out of and away from the end portion of the other one of the jackets. The visual indicator serves as a warning that excessive loads are being applied to the mooring line.

20 Claims, 9 Drawing Sheets

(51) Int. Cl.

| | |
|---|---|
| ***D07B 1/04*** | (2006.01) |
| ***D07B 1/14*** | (2006.01) |
| *D07B 1/18* | (2006.01) |

(52) U.S. Cl.

CPC ..... *D07B 1/18* (2013.01); *D07B 2201/1096* (2013.01); *D07B 2401/205* (2013.01); *D07B 2501/2069* (2013.01); *D07B 1/02* (2013.01); *D07B 1/025* (2013.01); *D07B 2201/207* (2013.01); *D07B 2205/205* (2013.01)

(56) References Cited

U.S. PATENT DOCUMENTS

| | | | | |
|---|---|---|---|---|
| 3,968,725 | A | 7/1976 | Holzhauer | |
| 4,001,367 | A | 1/1977 | Guthrie et al. | |
| 4,321,854 | A | 3/1982 | Foote et al. | |
| 4,343,343 | A | 8/1982 | Reuter | |
| 4,446,944 | A | 5/1984 | Forrest et al. | |
| 4,563,869 | A | 1/1986 | Stanton | |
| 4,650,715 | A | 3/1987 | Voser | |
| 5,398,634 | A | 3/1995 | Eagan | |
| 6,257,163 | B1 | 7/2001 | Carpenter | |
| 6,533,066 | B1 | 3/2003 | O'Dell | |
| 7,461,500 | B2 | 12/2008 | Theis | |
| 7,703,372 | B1 | 4/2010 | Shakespeare | |
| 7,743,885 | B2 * | 6/2010 | Martin et al. | 182/3 |
| 8,136,438 | B2 * | 3/2012 | Shakespeare | 87/6 |
| 8,365,646 | B2 * | 2/2013 | Fields | 87/2 |
| 2003/0154802 | A1 * | 8/2003 | Culshaw et al. | 73/800 |
| 2003/0197303 | A1 | 10/2003 | Chuah et al. | |
| 2005/0039668 | A1 | 2/2005 | Sanford | |
| 2005/0217748 | A1 | 10/2005 | Ikegami | |
| 2008/0028740 | A1 | 2/2008 | Ushijima | |
| 2010/0162882 | A1 | 7/2010 | Shakespeare | |
| 2011/0239420 | A1 | 10/2011 | Abell | |

* cited by examiner

MOORING LOOP

TECHNICAL FIELD

An embodiment of at least one invention described herein relates to securing devices capable of safely absorbing and dissipating energy associated with mooring lines for a ship.

BACKGROUND

Securing devices such as ropes and lines are often used to secure objects and people from moving or falling. Examples include lines for mooring ships and safety ropes used by mountain climbers and construction workers. Securing devices in the form of sheets and nets may also be used to stop falling or moving objects and people. In each of these cases, the object or person may exert high forces on the securing device, which cause the securing device to break prematurely and/or cause harm to the object or person being secured. For example, lash back from a broken mooring line can harm a person near the broken line. Also, the sudden stopping forces acting on a falling person or object caused via a rope, line or net can injure the person or object being secured. Thus there exists a need for securing devices which offer greater safety protection to the persons and objects associated with or near the securing devices.

BRIEF SUMMARY

It is an object of an example embodiment of at least one invention to provide a securing device.

It is a further object of an example embodiment of at least one invention to provide a securing device which provides greater safety to objects and persons associated with and/or near the safety device.

Further objects of example embodiments will be made apparent in the following Detailed Description and in the appended claims.

The foregoing objects may be accomplished in a new securing device that is capable of being used as and/or integrated into ropes, lines, nets, lanyards, sheets or other devices that can be used to secure objects and people and accomplish the absorption and dissipation of energy.

In an example embodiment, the securing device is capable of elongating and dissipating energy in a load with predetermined characteristics applicable to the intended use of the securing device. Example embodiments of the securing device may be comprised of a plurality of components. The plurality of components may include at least one reactive fiber component comprised of a stretchable non-elastic polymer fiber capable of dissipating kinetic energy in a load as the fiber stretches.

In some embodiment, the plurality of components may also include an initiating fiber component that breaks under a predetermined amount of force prior to allowing the reactive fiber component to substantially elongate. For example, depending on the intended use of the securing device, at the predetermined level of force, the initiating fiber may be adapted to break and allow the reactive fiber to stretch and minimize lash back. An initiating fiber component may also be used in a securing device to prevent the securing device from prematurely stretching.

However, it should be appreciated that in other embodiments of the securing device, an initiating fiber component may not be used. Rather, a suitable amount of reactive fiber components may be bundled together which have an aggregate resistance to stretching of any substantial amount. When a load above the aggregate resistance threshold is applied to the bundle, the reactive fiber components may begin stretching until the load is reduced and/or until the reactive fiber components stretch a sufficient amount to break apart. Such an embodiment in the form of a mooring loop may serve in the role of a time delay fuse when placed in series with a mooring line and a bollard. When such a mooring loop begins to stretch, the visual appearance of the stretching mooring loop may serve as a warning to mooring personnel near the mooring lines to either reduce the load and/or apply more mooring lines.

In other embodiments, the securing device may be comprised of at least one terminating fiber component that is operative to initially elongate without substantially dissipating kinetic energy in the load while the reactive fiber component stretches. However, at a predetermined increase in length of the securing device, the terminating fiber component may operate to prevent further elongation of the securing device and to dissipate any remaining kinetic energy in the load (e.g., bringing a falling object to a stopping point).

In addition, in some embodiments the securing device may be comprised of a filler material operative to minimize binding or tangling of the reactive fiber component and the terminating fiber component during elongation of the securing device.

DETAILED DESCRIPTION

Figure 34:
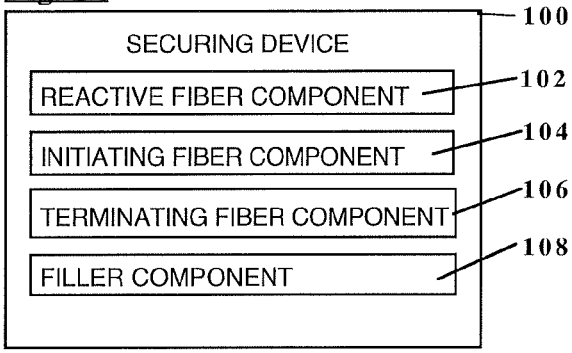
FIG. 34 illustrates a schematic view of an example embodiment of a securing device.

Referring now to the drawings and particularly to FIG. 34, there is shown therein a schematic view of an example embodiment of a securing device 100. Examples of securing devices include ropes, lines, nets, lanyards and other devices that can be used to secure objects and persons. Embodiments of the securing device 100 described herein are capable of stretching under load and dissipating energy in the load over a period of time as the securing device elongates. An example of a load may include a falling person or object secured via an embodiment of the described securing device in the form of a safety rope, loop, or lanyard. An example of a load may also include a moored ship secured to a dock via an alternative embodiment of the described securing device in the form of a mooring loop. An example of a load may also include a flying or moving object that is captured by an alternative embodiment of the described securing device in the form of a composite reinforced material, net, and/or fabric. In general, example embodiments of securing devices may be used to safely reduce kinetic energy in an object or person and/or safely dissipate built up potential energy in the device.

Example embodiments of securing devices described herein may be used in applications associated with fall protection, mountain climbing equipment, parachute shrouds, seat belts, safety harnesses, cargo restraining systems, military personnel drops, safety seating for military aircraft, safety barriers for sporting events, lifting systems, mooring systems or any other application in which there is a need for a device that resists, slows and/or stops movement of objects and people.

In example embodiments, the securing device 100 may be comprised of at least one reactive fiber component 102 capable of stretching under load and dissipating kinetic energy in the load as the reactive fiber is stretched. In an example embodiment, the reactive fiber component is comprised of a stretchable non-elastic synthetic polymer fiber. Examples of stretchable fibers capable of being used for the reactive fiber component described herein include polymer fibers comprised of a polyamide (e.g., nylons), polyesters, polypropylene, or other stretchable, generally non-elastic polymer fibers capable of being extruded, from a spinneret for example. In examples, the particular type of polymer fiber selected for use with embodiments of the reactive fiber components may by hydrophobic rather than hydrophilic. As used herein hydrophobic polymer fibers are generally antagonistic to water and are generally incapable of dissolving in water. Examples of hydrophobic polymer fibers include polyester fibers and polypropylene fibers for example. Examples of polymer fibers that are generally not hydrophobic include nylon fibers.

Operation of modern fiber producing equipment typically operates to draw out (stretch) the initial fibers produced by the spinneret to increase the tenacity of the fibers. In general, the drawing out of polymer fiber causes the molecules in the polymer fiber to become more longitudinally aligned (more oriented), which increases the tenacity of the fiber. However, in example embodiments of the described securing device, the reactive fiber component may be comprised of synthetic polymer fiber that has not been drawn out (stretched) after generation by the spinneret (e.g., the molecules in the fiber remain substantially unoriented).

As used herein, such polymer fibers in a state prior to being drawn out are called undrawn polymer fibers. The initial form of the described securing devices (prior to use) comprises at least one reactive fiber component including undrawn polymer fibers. The stretching of the securing device (during use) causes the undrawn polymer fibers to stretch, which stretching dissipates energy in the load that is causing the securing device to stretch. Undrawn fibers usable as the reactive fiber component in the example embodiments of the securing device may have a range of elongation without recovery, primarily in the range of as much as 150 percent to 3,000 percent or more.

Example embodiments of the securing device may also be comprised of reactive fiber components which are substantially undrawn (e.g., partially drawn out). Further, other alternative embodiments may be comprised of reactive fiber components which have both undrawn polymer fibers and substantially undrawn polymer fibers. As used herein, undrawn polymer fibers are polymer fibers that have not been drawn out in length after or during their initial extrusion. In addition, as used herein, substantially undrawn polymer fibers are polymer fibers that are capable of elongation without recovery greater than commercially available POY yarn. In an example, substantially undrawn polymer fibers correspond to fibers that are capable of elongation without recovery of at least 225 percent. In example embodiments described herein, the reactive fiber components include at least one of: an undrawn, hydrophobic polymer fiber, or a substantially undrawn hydrophobic polymer fiber, or any combinations thereof. Such reactive fiber components may be capable of stretching without recovery 300 percent (e.g. three times its initial length). In further alternative embodiments, reactive fiber components may be capable of stretching without recovery 600 percent or more.

Also, in further alternative embodiments, the securing device may be comprised of a plurality of different reactive fiber components, each having different resistive characteristics, lengths, diameters, weaves, and/or functions to achieve different rates of energy dissipation according to the requirements of the application.

In some example embodiments, the securing device 100 may also be comprised of one or more components in addition to the at least one described reactive fiber component 102 comprised of an undrawn fiber or substantially undrawn fiber. For example, an additional component may include at least one first initiating fiber component 104 which will initiate the energy absorption process. Such an initiating fiber component may be designed to break under a predetermined load before it allows the reactive fiber component to stretch a substantial amount. For applications such as a mooring loop, the initiating fiber may be adapted to break under a relatively large amount of force and thereby permit the reactive fiber component to stretch and safely release potential energy in an attached mooring line. However, it is to be understood that in alternative embodiments of a mooring loop, an initiating fiber may not be used. Also, in other applications, an initiating fiber may be used which is adapted to break under a relatively smaller amount of force to serve primarily to hold the securing device together and prevent premature stretching during assembly or storage.

In some example embodiments, an additional component may include at least one terminating fiber component 106, which takes over the load after a predetermined length of elongation of the securing device. For applications such as a safety rope or lanyard, the terminating fiber component may be adapted to dissipate the remaining kinetic energy in the load to a zero point so as to bring a falling object or person to a stop and/or to secure the object or person after being stopped.

In example embodiments, the initiating fiber component and the terminating fiber component may be comprised of synthetic polymers that have high tenacity. As a result, the ability of these additional components to stretch may be substantially less than that of the reactive fiber component. In example embodiments, the terminating fiber component may be comprised of a high tenacity polyester or para-aramid (e.g., Kevlar) or other high tenacity polymer capable of stopping a load on the securing device after a certain amount of elongation of the securing device. Also in example embodiments, the initiating fiber may be comprised of a polymer such as a polyester, polyethylene or another polymer capable of serving as a fuse that breaks with a predetermined amount of load to enable the securing device to begin elongation.

The terminating fiber component (and/or other fiber components) of the securing device may be assembled in a plurality of different ways, such as: in a configuration with overlapping compacted layers, coils, or folds; or in a configuration with a compressed weave. With these described configurations, the terminating fiber component (and/or other fiber components) is enabled to uncompress, uncoil, and/or unfold, without stretching and without substantial energy absorption and dissipation until a predetermined length of the securing device is reached (e.g., until layers of the weave for the respective component become orientated more longitudinally or the compacted layers of the component fully uncoil or unfold). Thus the terminating fiber component (and/or other fiber components) of the securing device may elongate (without stretching) while simultaneously the other fiber components (such as a reactive fiber component) stretches.

When the component that is stretching reaches a breaking point, one or more of the other components may be configured to reach their maximum elongation length (without stretching) as well. If the component reaching its maximum elongation length (without stretching) corresponds to a terminating fiber component, it may have sufficient tenacity to stop the securing device from further elongation or secure the securing device after a full stop.

However, if the component reaching its maximum elongation length without stretching corresponds to another reactive fiber component, it may then begin stretching to take over energy dissipation. Thus a securing device may be capable of using multiple reactive fiber components, which initiate stretching in stages at different predetermined elongation points of the securing device. Such a multi-stage securing device may enable the securing device to carry out energy dissipation over a greater length than a securing device with only one reactive fiber component. Also each stage may be comprised of reactive fiber components with different force resisting properties. For example, each subsequent stage may include a reactive fiber component with progressively greater resistance to stretching so as to achieve progressively greater levels of deceleration of the object or person causing the securing device to elongate.

To form compacted layers of a terminating fiber component (and/or other fiber components) using a braid weave, the weave pattern of the fibers may orientate the fibers to extend in directions closer to being perpendicular to rather than parallel to the longitudinal direction of the securing device. As the securing device elongates, the directions of the fibers in the weave may pivot to extend closer to being parallel to the longitudinal direction. During elongation, the outer diameter of the braided component may also decrease in size.

Compacted components that are not braided may be formed by orientating the component in a compressed arrangement, such as by having it oriented in a coil and/or a folded configuration. Elongation of the securing device causes the component to be uncoiled, unwound and/or unfolded.

To prevent the one or more components of the securing device from binding or becoming tangled as the securing device stretches, an example embodiment of the securing device 100 may include a filler component 108 running the length of the initial (non-elongated) form of the securing device to separate one or more of the components of the securing device. Such a filler component may be comprised of a polyethylene foam or other relatively lightweight and flexible material that is capable of reserving interior space of the securing device prior to use of the device, yet which is a material that upon elongation of the device, breaks apart in a manner that does not interfere with the elongation of the other components of the securing device.

FIGS. 1-33 show various example embodiments for securing devices and/or example configurations of components that may be integrated into a securing device for use in more complex securing devices and apparatuses that employ securing devices. Thus, although each of the examples shown in FIGS. 1-33 is referred to herein as a securing device, it is to be understood that each of the examples shown in FIGS. 1-33 may also correspond to a securing device material or component for use in constructing a more complex securing device.

Figure 1:
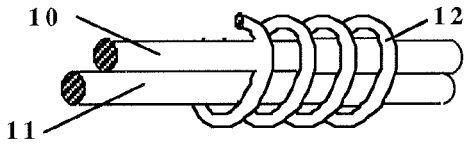
FIGS. 1-33 show example embodiments of securing devices and/or example configurations of a securing device that may be formed into more complex securing devices and apparatuses that employ the securing devices.

With reference to FIG. 1, there is illustrated an example of a securing device in the form of a yarn comprised of three components including an initiating fiber component 10, a reactive fiber component 11, and a terminating fiber component 12. Each of these fiber components may be comprised of a plurality of strands manufactured using a textile process which assembles groupings of polymer fiber strands. As illustrated in FIG. 1, the terminating fiber component in this example may be wrapped around the other two fiber components. It will also be understood that this securing device may include more than one type of each fiber. It will also be appreciated that any combination of yarns and/or strands in the yarns can be mixed and matched in order to achieve a specific result. The particular yarn illustrated in FIG. 1 may be used for either a woven or knit fabric, for example.

Figure 2:
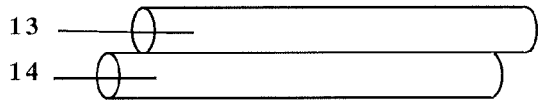

FIG. 2 illustrates another construction of an example securing device in the form of a yarn. Here the yarn is made from an initiating fiber component 13 and a reactive fiber component 14. The yarn shown in FIG. 2 may be used as a primary building block for constructing more complex securing devices.

Figure 3:
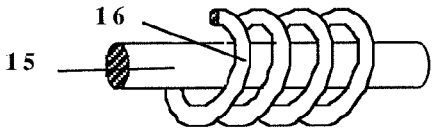

FIG. 3 is similar to FIG. 2 in that it represents a primary building block yarn for creating more complex securing devices. In this example embodiment, the yarn includes a reactive fiber component 15 that is wrapped with a terminating fiber component 16.

As used herein, components such as the reactive fiber component, terminating fiber component and initiating fiber component may have a form that corresponds to one or more fibers, strands, yarns and/or another building block capable of being braided, woven, stitched or otherwise integrated into a securing device.

Figure 4:
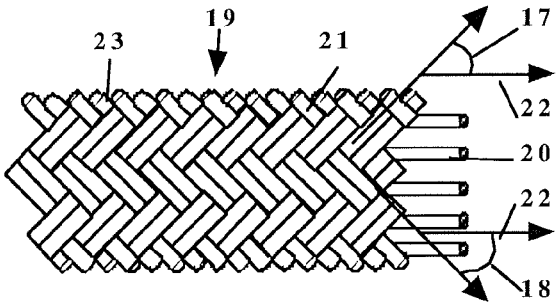

FIG. 4 is a side view of an example securing device 19 for use in a lanyard. Here the securing device includes a terminating fiber component 23 in the form of a plurality of yarns braided in a standard basket weave to form an outside jacket 21. In addition, in this example embodiment the securing device may include a reactive fiber component 20 in the form of a plurality of warp yarns that run parallel within the braid of the jacket 21.

Figure 5:
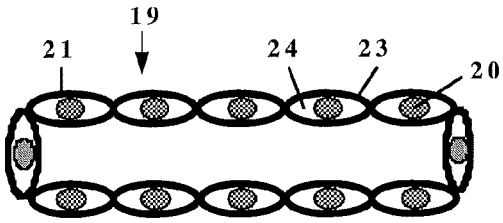

FIG. 5 is an axial view of the securing device 19 showing terminating fiber component yarns 23 of the jacket 21 braided around the reactive fiber component yarns 20. As illustrated in FIG. 5, the jacket 21 may be constructed so as to include sufficient space 24 adjacent the reactive fiber component yarns 20 to permit the reactive fiber component yarns 20 to stretch with minimal resistance from the terminating fiber component yarns 23 of the jacket 21.

Figure 6:
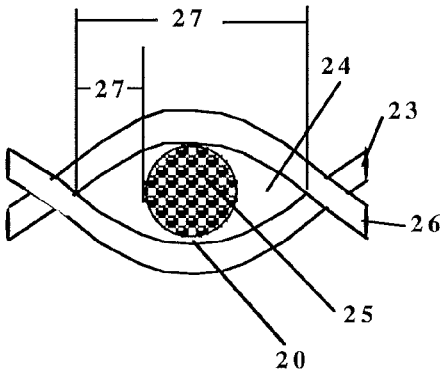

FIG. 6 is a blowup of FIG. 5 showing a reactive fiber component yarn 20 having the terminating fiber component yarn 23 braided thereabout, and showing the spacing or construction allowance 24 therebetween. FIG. 6 also illustrates that the reactive fiber component yarn 20 is itself made up of multiple reactive fiber component strands 25. Also, FIG. 6 illustrates that the terminating fiber component yarn 23 is itself made up of multiple terminating fiber component strands 26. Numeral 27 illustrates the space or construction allowance between the reactive fiber component yarn 20 and the terminating fiber component yarn 23.

As shown in FIG. 4 in an example embodiment, the terminating yarns are braided in directions that extend at large angles 17, 18 (e.g., between 30 and 90 degrees) relative to the longitudinal axis 22 of the securing device 19. As the securing device elongates, the braid ends move or pivot to decrease the angles 17, 18 so as to be closer to parallel relative the longitudinal axis 22. The terminating fiber component yarns generally become as straight as possible given the mechanical properties of the weave. Also as the securing device elongates, the terminating fiber component yarns constrict the space 24 around the reactive fiber component yarn 20. Thus example embodiments of the securing device as shown in FIG. 6 may be constructed to provide space 24 around the reactive fiber component yarn 20 so as to allow sufficient room for the reactive fiber component yarn to stretch a required amount before the jacket 19 or terminating fiber component yarn 23 pinches it. The size of the space 24 may vary based upon the types of reactive fiber components used, the type of textile (such as rope versus woven fabric), and the distance to total elongation required.

Figure 7:
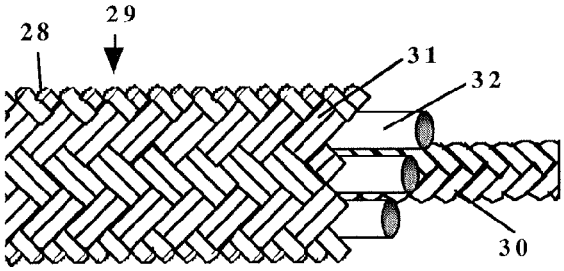

FIG. 7 shows a cutaway of an example securing device 29 in the form of a double braided rope comprised of three different components: a reactive fiber component yarn 30; a terminating fiber component yarn 31; and a filler component 32. The terminating fiber component yarn 31 may be braided into a hollow jacket 28. The filler component 32 may be comprised of a foam which serves to reserve the previously described space or construction allowance between the reactive fiber component yarns 30 and the terminating fiber component yarns 31. The filler component 32 may be fed into the braiding machine at the same time as when the jacket is braided around the terminating fiber component yarn 30. The filler material 32 adds volume to the core of the jacket 29, which makes the inner diameter of the jacket substantially larger than the outer diameter of the reactive fiber component yarn 30. The filler component 32 can be any material that does not appreciably affect the mechanics of elongation of the securing device. Hence, a material such as a foam or another material that destructs easily and does not interfere with the other components of the securing device may be used for the filler component 32.

Figure 8:
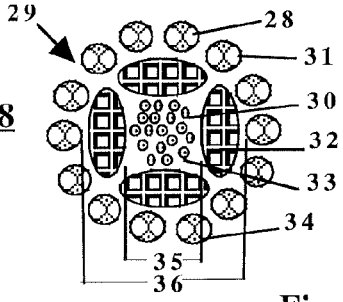

FIG. 8 is a cross section of the securing device 29 shown in FIG. 7. FIG. 8 illustrates that the reactive fiber component yarns 30 may be comprised of strands 33 of reactive fiber components. Also, FIG. 8 illustrates that the terminating fiber component yarns 31 may be comprised of strands 34 of terminating fiber components. In this example embodiment, the reactive fiber component yarns 30 may be braided as well.

FIG. 8 also illustrates an example placement of the filler components (e.g., columns of foam) oriented at locations around the reactive fiber component yarns 30 to consume space between the outer diameter 35 of the braided or grouped reactive fiber component yarns 30 and the inner diameter 36 of the jacket 28.

Figure 9:
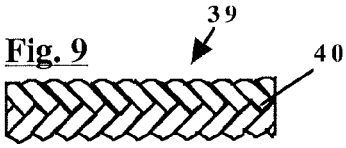
Figure 10:
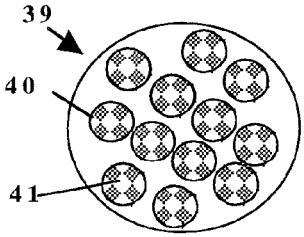
Figure 11:
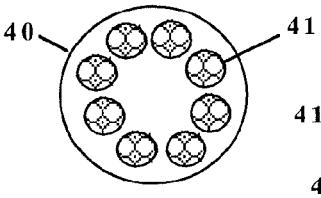
Figure 12:
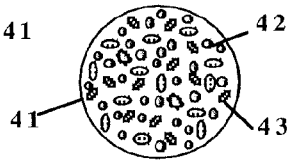

FIG. 9 shows an example of a securing device 39 in the form of a one-part braided rope. FIGS. 10, 11 and 12 show cross-sectional views of the securing device 39. In this example embodiment, each yarn 40 in the braid of the securing device 39 is comprised of many feed yarns 41, which are themselves comprised of many fiber strands 42, 43. In this embodiment, the feed yarn 41 may be a combination of reactive fiber component strands 42 and initiating fiber component strands 43 in one bundle. In this construction, the initiating fiber components may serve as a fuse that breaks at a predetermined point (of elongation and/or force), at which time the reactive fiber components take over and stretch until they break and release.

Figure 13:
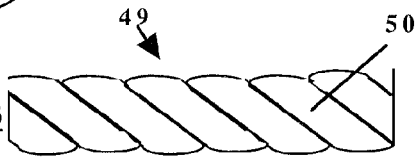
Figure 14:
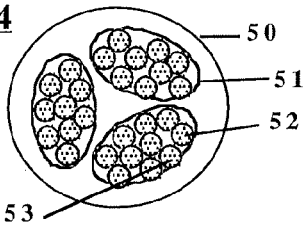
Figure 15:
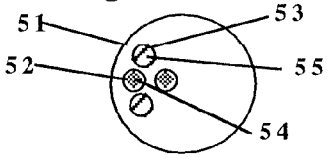

FIG. 13 shows another example embodiment of a securing device 49 in the form of a three-strand rope comprised of composite yarns 50. FIGS. 14 and 15 are cross-sectional views of the securing device 49 of FIG. 13 and illustrate that the composite yarns 50 are formed by a single lay 51 of both reactive fiber component yarns 52 and initiating fiber component yarns 53.

FIG. 15 illustrates that each reactive fiber component yarn 52 is comprised of reactive fiber components strands 54. Also, each initiating fiber component yarn 53 is comprised of initiating fiber component strands 55.

Figure 16:
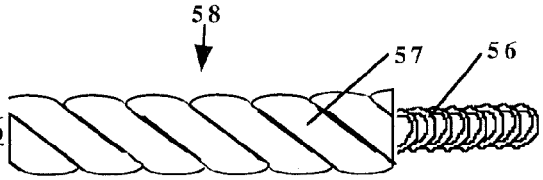

FIG. 16 shows an example embodiment of the securing device 58 in the form of a three-strand rope. Here a reactive fiber component is used to form the outside lay 57 of the securing device. The center of the securing device includes a terminating fiber component yarn 56 which takes on a coiled configuration. This compressed coiled configuration of the terminating fiber component yarn 56 is capable of uncoiling and expanding as the outside lay 57 (comprised of the reactive fiber component) stretches. In this embodiment, elongation of the securing device 58 will stop at the point when the terminating fiber component yarn 56 becomes fully uncoiled.

Figure 17:
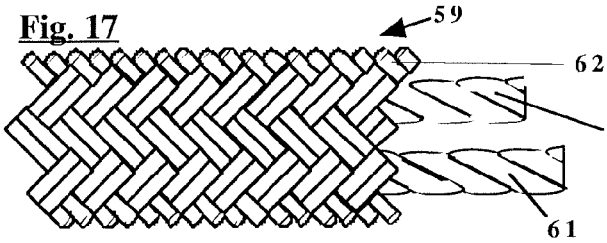
Figure 18:
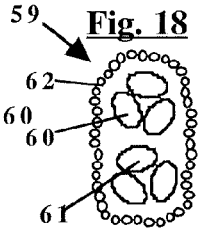

FIGS. 17 and 18 show an example embodiment of a securing device 59 in a form in which a braided jacket 62 is comprised of a terminating fiber component that is braided around two ropes (one rope 61 made of an initiating fiber component and one rope 60 made of a reactive fiber component). In this embodiment, the rope 61 comprised of an initiating fiber component serves as a fuse which breaks when a predetermined amount of force is applied. The breaking of the rope 61 permits the rope 60 comprised of the reactive fiber component to stretch and to enable the securing device 59 to elongate. During elongation of the securing device 59 (and stretching of the rope 60), the outer jacket expands. When the outer jacket becomes fully expanded it stops the elongation of the securing device (and stretching of the rope 60).

Figure 19:
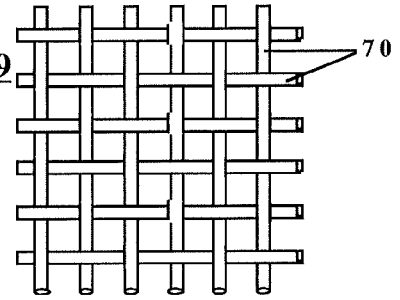
Figure 21:
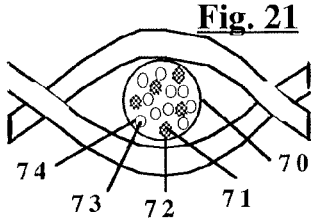
Figure 20:
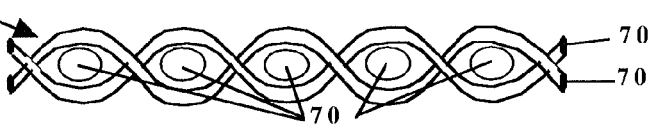

FIGS. 19 through 21 illustrate an example embodiment of a securing device 69 in the form of a woven fabric which is made from a composite yarn 70. As shown in FIG. 21 the composite yarn 70 is comprised of two types of yarn: a reactive fiber component yarn 72 comprised of reactive fiber component strands 71; and initiating fiber component yarns 74 comprised of initiating fiber component strands 73.

Figure 22:
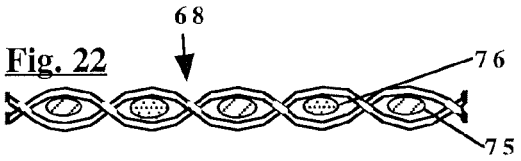
Figure 23:
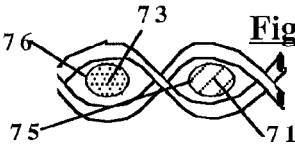

FIGS. 22 and 23 illustrate an example embodiment of a securing device 68 in the form of a woven fabric which is made from alternating different types of yarn instead of a composite yarn as shown in FIGS. 19-21. As shown in FIGS. 22 and 23 the alternating different types of yarn include the following: a reactive fiber component yarn 75 comprised of reactive fiber component strands 71 and an initiating fiber component yarn 76 comprised of initiating fiber component strands 73.

Figure 24:
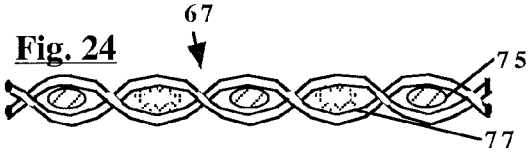
Figure 25:
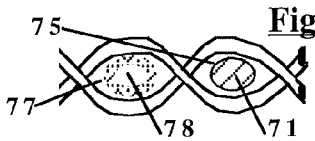

FIGS. 24 and 25 illustrate another example embodiment of a securing device 67 in the form of a woven fabric which is made from alternating different types of yarn. Here the alternating different types of yarn include the following: a reactive fiber component yarn 75 comprised of reactive fiber component strands 71 and a terminating fiber component yarn 77 comprised of terminating fiber component strands 78.

Figure 26:
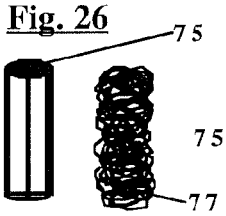
Figure 27:
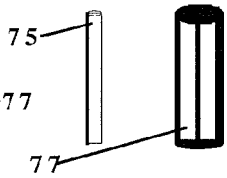

FIGS. 26 and 27 illustrate the securing device 67 in different states. FIG. 26 shows a portion of the securing device prior to use in an unelongated state. Here the reactive fiber component 75 is shown unstretched and the terminating fiber component 77 is shown coiled and/or compressed. FIG. 27 shows a portion of the securing device after a force has been applied which elongates the device to its maximum length. Here the reactive fiber component 75 is shown after being stretched and the terminating fiber component 77 is shown uncoiled.

Figure 28:
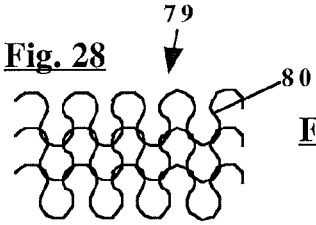
Figure 29:
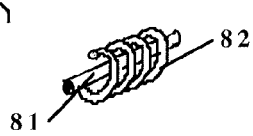

FIGS. 28 and 29 illustrate another example embodiment of a securing device 79 in the form of a knit fabric which is made from a composite yarn 80. As shown in FIG. 29 the composite yarn 80 is comprised of a terminating fiber component 82 that is wrapped around a reactive fiber component 81.

Figure 30:
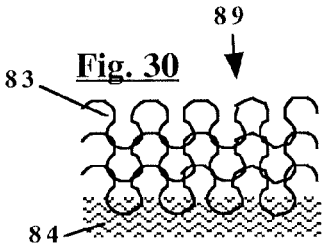
Figure 31:
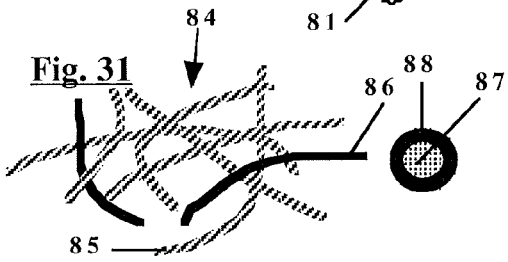

FIGS. 30 and 31 illustrate another example embodiment of a securing device 89 in the form of a stitched bonded fabric made by knitting or stitching a terminating fiber component yarn 83 into a non-woven fabric 84. As shown in FIG. 31, the non-woven fabric may be comprised of a reactive fiber component yarn 85. Also the non-woven fabric may be comprised of a bi-component binder fiber 86 comprised of a high melt polymer 87 and a low melt polymer 88. Here the inner core of the bi-component binder fiber 83 may be formed from the high melt polymer 87, and the outside jacket of the bi-component binder fiber 83 may be formed with the low melt polymer 88. The two reactive fiber components, yarn 85 and the bi-component binder fiber 86, may be blended together and run through a heated colander which causes the low melt polymer to melt and combine the entire mass together.

The final form of this example embodiment of a securing device 89 may be a flat fabric capable of stretching. Stretching of the fabric causes the knit of the terminating fiber component to stretch and lengthen. The fabric will stop stretching once the terminating fiber component has reached its maximum nit fabric stretch.

Figure 32:
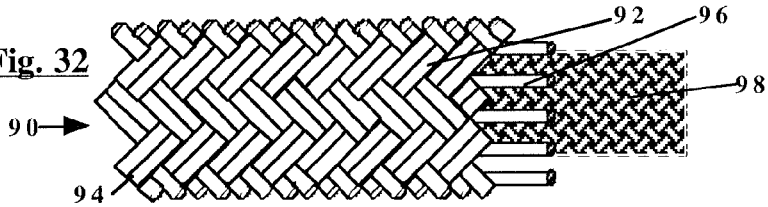
Figure 33:
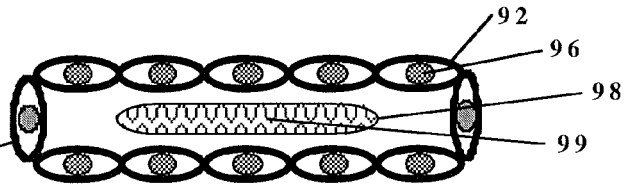

FIG. 32 is a side view of an example securing device 90. Here the securing device includes an outside jacket 92 comprised of a plurality of terminating fiber component yarns 94 braided in a standard basket weave. In this example embodiment the securing device may include a plurality of spaced-apart initiating fiber component yarns 96 in the form of warp yarns that run parallel within the braid of the jacket 92. As shown in FIG. 33 within the core of the jacket, the securing device 90 may include a reactive fiber component 98 comprised of a flat braid of reactive fiber component yarns 99.

In this example embodiment of the securing device, the initiating fiber component yarns 96 may be bonded to the terminating fiber yarns 94 in the jacket 92 to keep the securing device together in a compressed and stable form. When being used to stop a falling object or person the initial force of the falling object or person will cause the initiating fibers to break, which frees the jacket to expand and the reactive fiber component 98 to stretch. Stretching of the reactive fiber component 98 dissipates kinetic energy in the object and person. Then upon reaching maximum expansion of the jacket, the jacket will bring the object and person to a full stop.

Example 1

A test example of the securing device 19 shown in FIG. 4 was made. For this test example, the reactive fiber component yarns 20 were formed from 13 ends, 1727 denier polyester with a reactive elongation factor greater than 8.5 reactive elongation, wound parallel. Also in this test example, the outside jacket (the terminating fiber component 21) was formed with 10 ends, 1000 denier high tenacity polyester with 0 percent reactive elongation, twisted 1.25 turns per inch, 2 yarns per bobbin braided with a construction ratio of greater than 1.1, 24 carrier maypole braid. The resulting securing device was tested against a weight of 220 pounds falling 72 inches. From an initial length of 74.25 inches, the securing device elongated a total of 41.5 inches to stop the fall of the test weight.

Example 2

A test example of the securing device 29 shown in FIG. 7 was made. For this test example, the reactive fiber component yarn 30 was formed from 65 ends, 1727 denier polyester with a reactive elongation factor greater than 8.5 reactive elongation, twisted 1.25 turns per inch, 1 yarn per bobbin, braid angle at 45 degrees, and at 24 carrier maypole braid. The terminating fiber component yarn 31 was formed from 30 ends, 1000 denier high tenacity polyester with 0 reactive elongation, twisted 1.25 turns per inch, having 1 yarn per bobbin and having a construction ratio greater than 1.1 and 16 carrier maypole braid. The filler component 32 comprised 4 ends, % inch polyethylene foam backer rod. This example of the securing device was tested with a test weight of 220 pounds, falling a distance of 6 feet. From an initial length of 73.76 inches, the securing device experienced a total elongation of 34.25 inches to stop the fall of the test weight.

Example 3

A test example of a securing device with a construction similar to the securing device 89 shown in FIG. 32 was made. For this test example, the reactive fiber component 98 was comprised of an un-oriented (undrawn) polypropylene yarn of 3430 denier manufactured by FIT fiber in Johnson City, Tenn. The reactive fiber component 98 was pre-assembled into a core yarn comprised of a total denier of 226,380 in a 66 carrier flat braid. Pick count yielded a tight braid of about 45 degrees braid angle producing a reactive fiber component 98 for use as a core yarn with an approximate width of 1.5 inches.

Also in this test example the outside jacket 92 (comprising the terminating fiber component yarns 94) was comprised of a para-aramid under the trademark Kevlar, manufactured by E.I DuPont de Nemours & Co. in Richmond, Va. The weave of the terminating fiber component yarns 94 was constructed with one end of 3000 denier type 29 Kevlar.

The initiating fiber component yarn 96 corresponded to a composite initiating fiber component yarn constructed with: four ends of a 300 denier, parallel wound bi-component sheath core yarn; and four ends of the 3430 denier un-oriented polypropylene discussed previously. The bi-component sheath core yarn was comprised of a polyester core with a melt point of 480 degrees Fahrenheit and a polyethylene jacket with a melt point of 107 degrees Fahrenheit manufactured by FIT Fibers of Johnson City, Tenn.

During construction of the jacket 92 the composite initiating fiber component yarns 96 were fed under constant tension into 12 warp tubes fitted to a Ratera, 24 carrier, 140 millimeter maypole braider. The preassembled core yarn comprising reactive fiber component 98 was fed under constant tension into the center of the braid of the jacket. The terminating fiber component yarn 94 of the jacket 92 was braided over the core yarn and around the warp yarns comprising the composite initiating fiber component yarns 96. Each of the 24 bobbins included a single end of the terminating fiber component yarns 94.

A modified braiding dye was utilized to form then outer jacket 92 with an inner diameter of 1.5 inches. The dye was designed to make each successive lay of the terminating fiber component yarn 94 advance. The takeoff of the braider was modified to accommodate flat structures and was equipped with a pair of hot rollers that belted the outer sheath of the initiating fiber component yarns 96 and bond them to the jacket 92, stabilizing the final product for additional processing into a finished unit.

Figure 35:
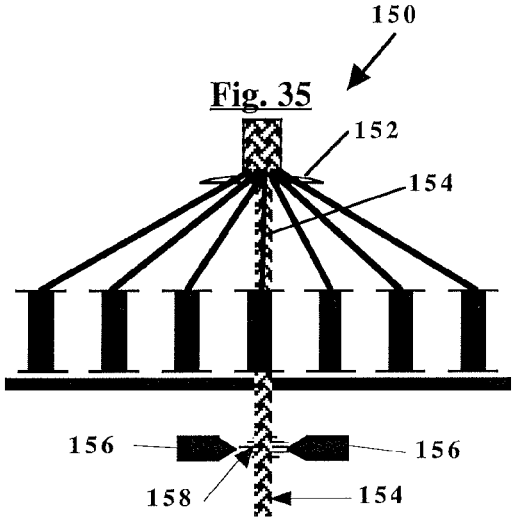
FIG. 35 shows an example configuration of a braiding machine for use with producing an example securing device.

In this example and/or other examples in which a jacket is braided around a reactive fiber component core, an adhesive may be applied to the reactive fiber component prior to entering the braiding die. FIG. 35 depicts an example of a braider 150 that is configured to braid a terminating fiber jacket on a modified braiding dye 152 around a reactive fiber core 154. In this example, spray devices 156 may be positioned to coat the outside of the reactive fiber core 154 with an adhesive 158 as the core enters the braider 150. The adhesive used in this example may include an adhesive capable of holding the jacket in place along the core and prevent premature elongation of the terminating fiber jacket. However, the adhesive must also be capable of having its adhesive bond between the jacket and core break under a predetermined amount of force to permit elongation of the jacket and core. For example in the case of a lanyard, an adhesive may be used that will enable an adhesive bond between the jacket and core to break in response to the initial forces of a falling person. An example of an adhesive that may be used in a lanyard application includes Simalfa X357, which is a water born adhesive that is a dispersion of acrylic resin and synthetic rubber in water supplied by Alfa Adhesives, Inc. located at 15 Lincoln Street, Hawthorne, N.J. 07506.

Figure 36:
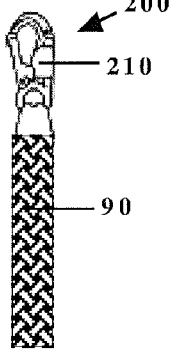
FIGS. 36-49 show examples of apparatuses that employ examples of the securing devices.
Figure 37:
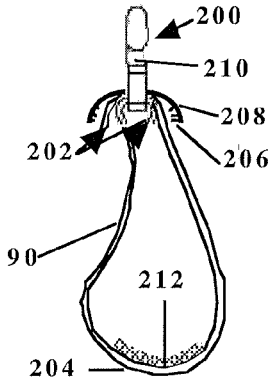

The previous examples of the securing device may be used in a plurality of different types of apparatuses for use with securing people, boats or other objects. For example the securing device 90 depicted in FIG. 32 may be integrated into a safety loop 200 as shown in FIG. 36. Such a loop may include a loop comprised of the example securing device 90 connected to a hook 210 via a fastener 208. FIG. 37 shows a side view of the safety loop 200 prior to the fastener 208 being clamped or crimped down holding opposed ends 202 of the securing device 90 together to the hook. The fastener 208 may include teeth 206 for example, that become imbedded in the securing device 90 to hold the safety loop together. An end 204 of the safety loop opposed of the hook 210 may also include reinforcement material 212 to minimize damage to the safety loop at the location the safety loop is connected to an anchor point, another hook, or other support. In addition the securing device 90 may be coated with a colorant (e.g., yellow) for safety recognition and/or other material for abrasion protection.

Figure 39:
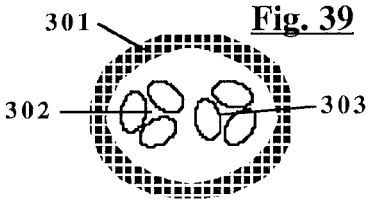
Figure 38:
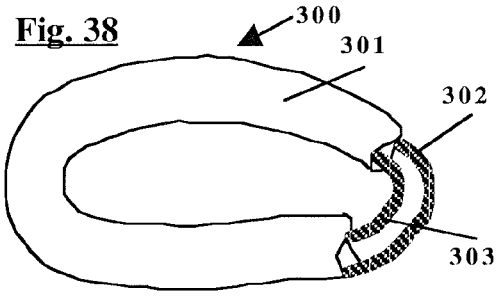
Figure 40:
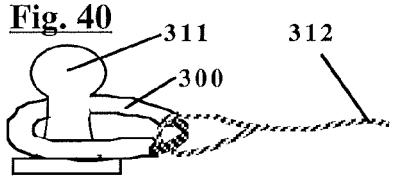

FIGS. 38-44 show further examples of apparatuses that use one or more of the previous described securing devices. For example FIG. 38 depicts a mooring loop 300 comprised of a securing device configured for use with mounting a mooring line 312 to a mooring bollard 311 as shown in FIG. 40. In use the mooring loop 300 may correspond to a fuse that provides elongation at a predetermined amount of force to minimize breaking of a mooring line which could lash backward with excessive force.

FIG. 39 shows a cross-sectional view of an example embodiment of a mooring loop 300. In this example the mooring loop is comprised of an anti-lashback jacket 301 that encases portions of a continuous loop of an initiating fiber component 302 and a reactive fiber component 303. The initiating fiber component 302 may be in the form of a three strand rope with ends spliced together into a continuous loop. The reactive fiber component 303 may also be in the form of a three strand rope with ends spliced together into a continuous loop. In this example the anti-lashback jacket may be comprised of a woven nylon or other material capable of encasing the initiating fiber component and reactive fiber component. When the initiating fiber breaks, the anti-lashback jacket contains the broken initiating fibers and prevents injury or damage from occurring to adjacent people or objects. The reactive fibers may then stretch to relieve forces in a mooring line 312.

Figure 50:
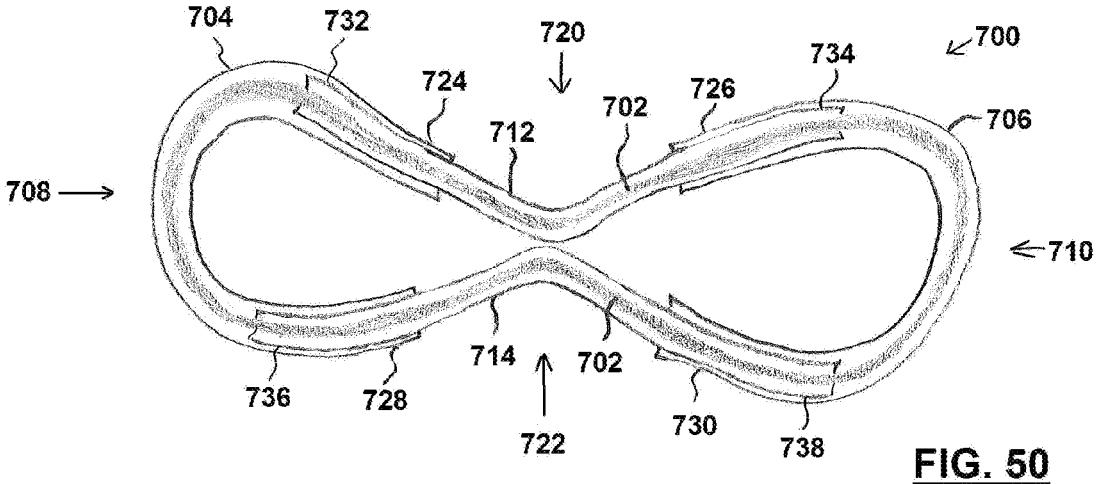
FIG. 50 illustrates a cross-sectional view of an example mooring loop.

However, it should be appreciated that in alternative embodiments of a mooring loop, an initiating fiber may not be needed. An example of such an alternative embodiment of a mooring loop 700 is shown in FIG. 50, which is discussed in more detail below.

Figure 41:
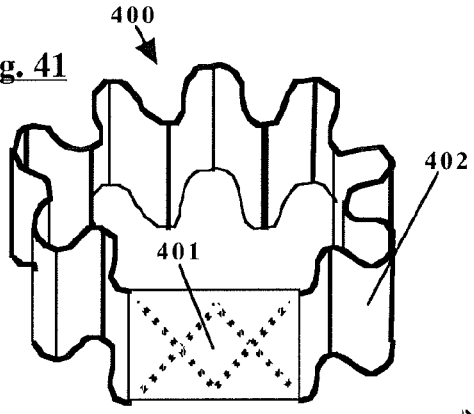
Figure 42:
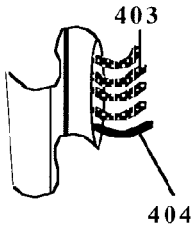
Figure 43:
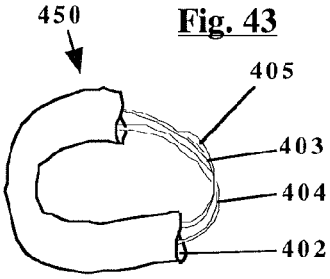

FIG. 41 depicts an example of a rope fuse 400 comprising an example securing device. The rope fuse is comprised of a gathered or compressed woven tube 402 that is secured to itself at 401 to form a continuous loop. As shown in FIG. 42, the woven tube may encase a plurality of strands/yarns of reactive fiber component 403 and one or more strands/yarns of an initiating fiber component 404. FIG. 43 shows an interior cross-section 450 of the rope fuse 400. As with the previously described mooring loop, the reactive fiber component (s) 403 and the initiating fiber component(s) 404 may have ends spliced together to form continuous loops 405. In this example, when the initiating fiber component breaks in response to a predetermined amount of force, the reactive fiber component may elongate while the gathered woven tube un-gathers into a fully expanded tube. Elongation of the reactive fiber component is operative to slow the object applying the force to the rope fuse. When the woven tube reaches its fully expanded configuration, it is operative to stop further elongation of the rope fuse.

Figure 44:
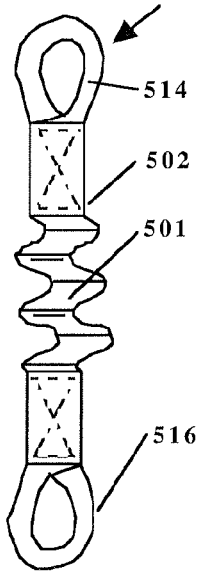
Figure 45:
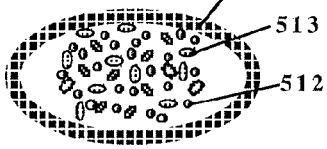

FIG. 44 depicts an alternative example of a safety lanyard 500 comprising an example securing device 502. Here the lanyard may be comprised of a securing device 502 with hooks 514 and 516 mounted to each end. The securing device may be comprised of a gathered woven tube 501 comprised of a terminating fiber component. As shown in FIG. 45, the gathered woven tube 501 may encase initiating fiber component(s) 512 and reactive fiber component(s) 513 with their ends also secured to the hooks 514, 516. In this example when the initiating fiber component breaks in response to a predetermined amount of force, the reactive fiber component may elongate while the gathered woven tube un-gathers into a fully expanded tube. Elongation of the reactive fiber component is operative to slow the object applying the force to the lanyard. When the woven tube reaches its fully expanded configuration it is operative to stop further elongation of the lanyard.

Figure 47:
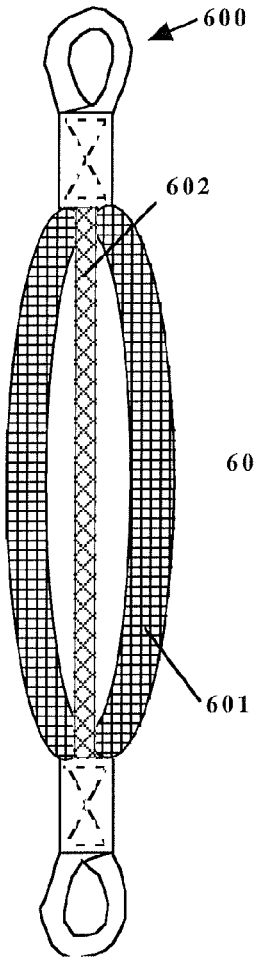
Figure 46:
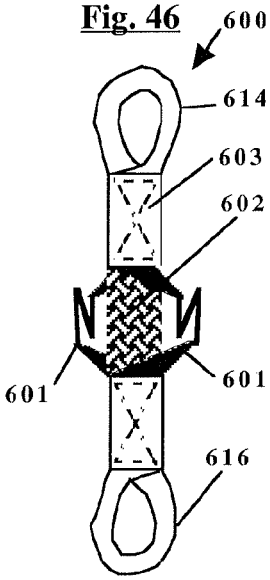
Figure 48:
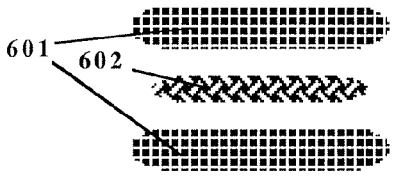

FIG. 46 depicts a further alternative example of a safety lanyard 600 comprising an example securing device 603. Here the lanyard may be comprised of a securing device 602 with hooks 614 and 616 mounted to each end. The securing device may include two parallel woven webs 601 comprised of a terminating fiber component with ends mounted to the hooks 614, 616. The securing device may also include a reactive fiber component 602 with ends mounted to the hooks 614, 616. FIG. 46 depicts the lanyard prior to use with the two woven webs 601 in a gathered folded form and the reactive fiber component 602 prior to elongation. FIG. 47 depicts the lanyard after use with the two woven webs 601 in an unfolded form and the reactive fiber component 602 elongated. FIG. 48 also shows a cross-sectional view of the unfolded form of the lanyard shown in FIG. 47. It is to be understood that FIGS. 46-48 are not drawn to scale. In an example implementation the elongated form of the safety lanyard 600 may be several times the length of the non-elongated form of the safety lanyard.

Figure 49:
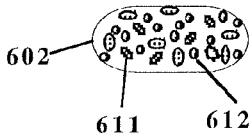

As shown in FIG. 49 the reactive fiber component 602 may be comprised of a reactive fiber component strands/yarns 611 braided into a rope or other form. In addition the lanyard 600 may include initiating fiber component strands/yarns 612 extending though the reactive fiber component rope with end mounts on the hooks 614, 616. In this example when the initiating fiber component breaks in response to a predetermined amount of force, the reactive fiber component may elongate while the two gathered woven webs unfold into a fully expanded form. Elongation of the reactive fiber component is operative to slow the object applying the force to the lanyard. When the two woven webs reach their fully expanded configuration, they are operative to stop further elongation of the lanyard.

As discussed previously such as with respect to FIG. 3, example embodiments may include wrapping (in the shape of a coil) a non-reactive fiber around an undrawn reactive fiber yard. Such a non-reactive fiber may be comprised of a carbon fiber or other typical composite reinforcing yarn. As discussed previously with respect to one or more of FIGS. 19-31, such a two-component yarn may be woven into heavy reinforcing fabrics and may be used in molding processes to form molded parts.

For example, such fabrics may be drawn over a form (e.g., a form for an automobile fender or door or other molded part). The portions of the fabric that cover a projecting portion of the mold may experience stretching via the reactive fibers stretching and the non-reactive fiber uncoiling, in order to create a relatively uniform yarn dispersion across the form shape.

The multi-density fabric may be warp, weft or even on the bias. Also, multiple layers of fabrics may be combined to make a multi-layer feedstock that when married to an automated production line can make component shaped carbon fiber reinforced parts as fast and at a lower cost than to make stamped metal.

For example in one example embodiment, a roll of conformable composite feedstock of this described woven material may be fed (in combination with a fast set resin such as a urethane) into a male/female mold. The portion fed into the mold may be cut from the feedstock and may be stamped by the mold into the shape of a finished part. The stamped feedstock may then be removed from the mold, and the process may continue with further portions of the feedstock fed into the mold to produce further parts. In other examples, vacuum form molding and/or other molding and stamping processes may be used to form parts out of the example feedstock. Such an example process could for example be used to stamp out an automobile door, which in combination with a fast-set resin may produce a finished part in about 15 seconds that is ready to paint, at a lower cost, with higher strength, and with one fifth the weight of a conventional steel door.

Also, as discussed previously, an example embodiment of a securing device may include a mooring loop that is placed in series in operative connection between a mooring line of a ship (or other movable structure) and a mooring bollard (or other mounting or anchoring structure such as a cleat or pole). Such a mooring loop may serve in the role of a time delay fuse that is operative to visually point out and provide time to correct an overloaded mooring line. FIG. 50 illustrates a cross-sectional view of an example embodiment of such a mooring loop 700. In this example, the mooring loop may be comprised of the previously described reactive fiber component 702 in the form of a rope that includes a plurality of reactive fibers formed into yarns and strands (e.g., three strands) that are spliced together at their ends to form a continuous loop.

Example embodiments of the mooring loop 700 may also include one or more jackets in surrounding relation around the reactive fiber components 702. For example, as shown in FIG. 50, a mooring loop may have first and second outer jackets 704, 706, which are respectively positioned in surrounding relation around opposed respective end portions 708, 710 of the continuous loop of the reactive fiber component 702. The mooring loop may also include first and second intermediate jackets 712, 714 positioned in surrounding relation around intermediate portions 720, 722 of the continuous loop of the reactive fiber component between the opposed end portions 708, 710. Such jackets may be comprised of a woven material (such as a woven polyester or other type of sheathing material that is formed in the shape of hollow tubes).

In example embodiments, portions of some of the jackets may extend inside portions of adjacent jackets. For example, as shown in FIG. 50, each of the first and second outer jackets 704, 706 includes end portions 724, 726, 728, 730 that extend in surrounding relation around the respective end potions 732, 734, 736, 738 of the intermediate jackets 712, 714. Thus prior to using the mooring loop, the jackets are positioned to cover all of the reactive fiber component.

Figure 51:
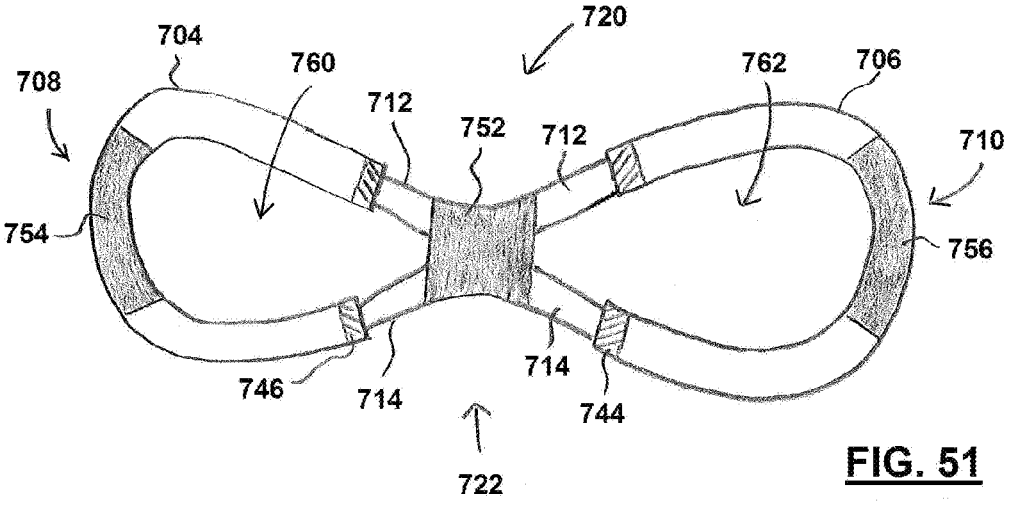
FIG. 51 illustrates an exterior top view of an example mooring loop.

In addition, example embodiments of the described mooring loop 700 may include reinforcing segments (e.g., comprised of rubber or other type of abrasion-resistant covering) mounted to and/or in surrounding relation around portions of the jackets to reduce chaffing of the mooring loop. FIG. 51 illustrates an outer exterior of the example embodiment of the mooring loop 700 in which reinforcing segments 752, 754, 756 are mounted to several places on the jackets 704, 706, 712, 714. For example, an intermediate reinforcing segment 752 may be mounted around the intermediate jackets 712, 714 so as to place the intermediate jackets 712, 714 and the intermediate portions 720, 722 of the continuous loop of reactive fiber component in side by side relation.

Also, a first end reinforcing segment 754 may be mounted around the first outer jacket 704 at one end portion 708 of the continuous loop. In addition, a second end reinforcing material 756 may be mounted to the second outer jacket 706 at the opposed end portion 710 of the continuous loop. The resulting shape of the mooring loop as shown in FIG. 51 may have the appearance of a figure eight (i.e., the shape of an "8") with two opposed apertures 760, 762.

Figure 52:
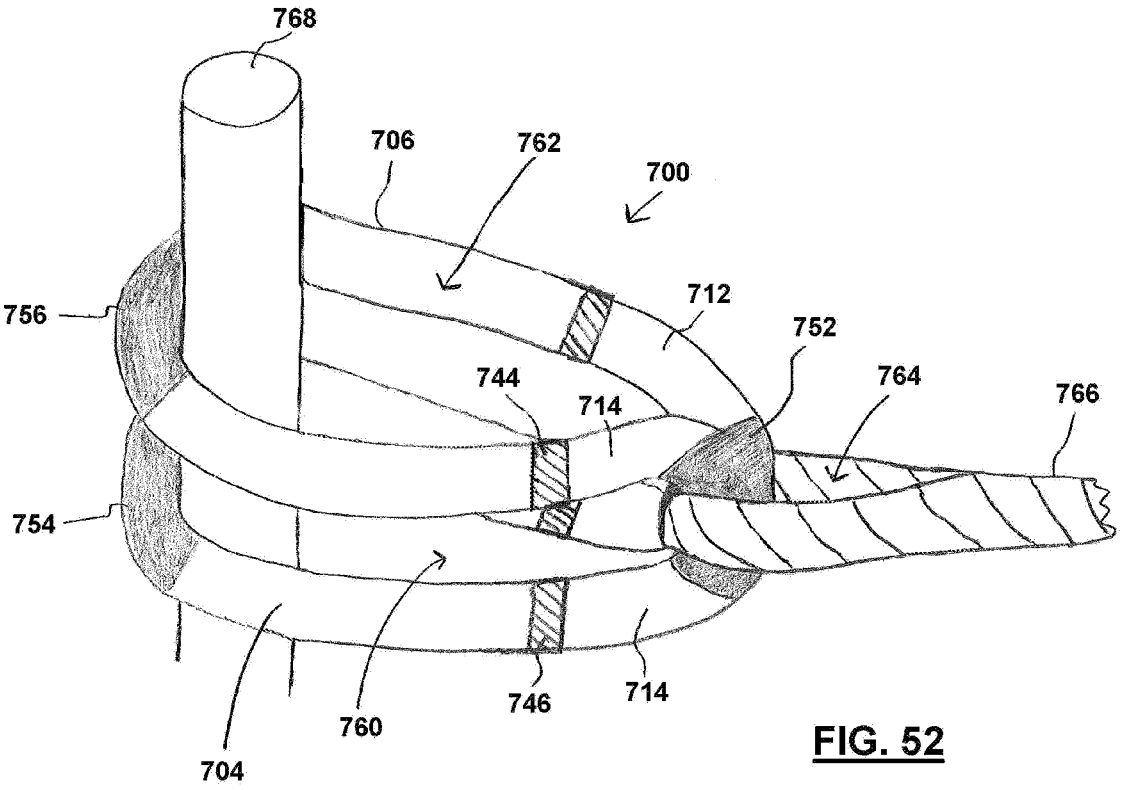
FIG. 52 illustrates a perspective view of an example mooring loop mounted between a bollard and a mooring line.

FIG. 52 illustrates a perspective view of an example of how the mooring loop 700 may be positioned in order to connect a mooring line 766 to a bollard 768 (or other mounting structure). As shown in FIG. 52, the mooring loop may be placed through a loop 764 in the end of the mooring line 766, such that the mooring line extends around the intermediate jackets 712, 714 (and intermediate reinforcing segment 752). The mooring loop 760 may then be folded at the intermediate reinforcing segment 752, such that the two apertures 760, 762 are in generally stacked relation. The arrangement enables the ends of the mooring loop to both be placed atop and around a bollard 768 (which extends through the two apertures 760, 762).

In this position, the first end reinforcing segment 754 and the second end reinforcing segment 756 are in contact with an outer surface of the bollard. Also, the intermediate reinforcing segment 752 is in contact with the mooring line 766. When a load is applied across the mooring line 766, mooring loop, 700, and bollard 768, the described reinforcing segments will be in positions that are operative to minimize the jacket and/or reactive fiber components from being torn via friction and chaffing by the bollard and mooring line.

In this example, the mooring loop 700 is operative to resist any substantial amount of stretching until a load above a desired load threshold is reached or surpassed. In addition, different mooring loops may be available with different load thresholds, for use with different sizes and strengths of mooring lines. In general, a mooring loop should be selected for a particular application such that the load threshold for the mooring loop is less than the load needed to cause the mooring line to break. When the load threshold for the mooring loop is surpassed, the reactive fibers in the mooring loop are operative to stretch to enable the entire mooring loop to expand in length for many multiples of its initial length until the mooring loop breaks (prior to the mooring line breaking).

In example embodiments, each of the fibers and/or yarns in the reactive fiber component may break at different lengths of stretch (and thus not all at the same time). As a result the mooring loop is operative to break apart in a cascading manner over a period of time in a manner that lowers the tension (and potential energy) in the mooring line, and thus prevents (or at least minimizes) the mooring line lashing/snapping backward with excessive force when the last of the reactive fibers in the mooring loop breaks.

In example embodiments, the previously described jackets 704, 706, 712, 714 do not stretch as does the reactive fiber component. As a result, when the reactive fiber component does stretch, the mooring loop elongates a sufficient amount that the end portions 732, 734, 736, 738 (shown in FIG. 50) of the intermediate jackets 712, 714 begin to pull out of and away from the end portions 724, 726, 728, 730 of the first and second outer jackets 704, 706. In example embodiments, when the jackets begin to separate as described, visual indicators may become visible on the mooring loop which visually warn users that the mooring loop is beginning to stretch. Such visual indicators may be regarded as a warning that the load being applied to the mooring line and mooring loop may be too high, and corrective action may need to be taken to prevent the mooring line and/or mooring loop from breaking.

Figure 53:
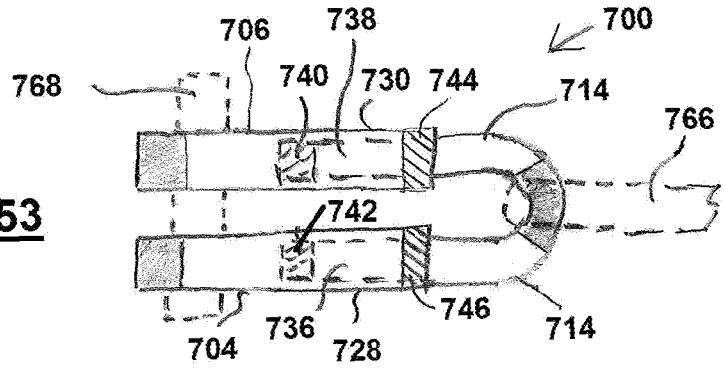
FIGS. 53-56 illustrate an example elongation of a mooring loop.
Figure 54:
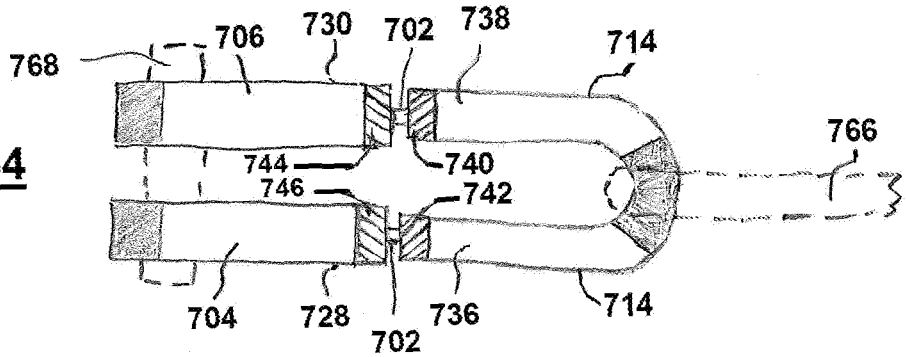

FIG. 53 shows an example of the mooring loop 700 mounted taunt between a bollard 768 and a mooring line 766. As shown in FIG. 53, the end portions 736, 738 of the intermediate jackets 712, 714 and the visual indicators 740, 742 thereon are still positioned inside the outer jackets 704, 706 and thus are not visible. FIG. 54 shows an example of the mooring loop after it has begun to stretch a sufficient amount to expose: a small amount of the reactive fiber component 702; the end portions 736, 738 of the intermediate jackets 712, 714; and the visual indicators 740, 742. Such visual indicators 740, 742 are represented by a darker shading in FIG. 54 and may be formed by placing a black band, tape, ink, paint, or other visual indicator on (and/or in surrounding relation to) the ends 732, 734, 736, 738 of the intermediate jackets 712, 714.

It should be understood that example embodiments may have any kind of visual indicator which has a high contrast and high probability of being seen relative to the appearance of the jackets 704, 706, 712, 714. For example, the jackets 704, 706, 712, 714 may have a neutral coloring such as grey, white, or tan. However, the visual indicators 740, 742 may have a different, and/or a higher contrast, and/or a more noticeable coloring, such as a red or black colored band, compared to the jackets. In example embodiments, the visual indicators 740, 742 may have a reflective coating to enhance visibility in the dark.

In addition, it should be appreciated that the end portions 732, 734, 736, 738 of the intermediate jackets 712, 714 (which are initially covered by the first and second outer jackets 704, 706) may have multiple levels of color and or other symbols or marks which indicate the degree and/or length of initial stretching of the mooring loop. For example, the first portion of the end portions 732, 734, 736, 738 that pull out of the end portions of the first and second outer jackets 704, 706 may have a first warning color such as green or yellow.

In addition, in further embodiments, the end portions 732, 734, 736, 738 may include a measuring scale with several marks, numbers or/or other indicia that indicate the number of centimeters or other units of length for which the mooring loop has stretched.

Figure 55:
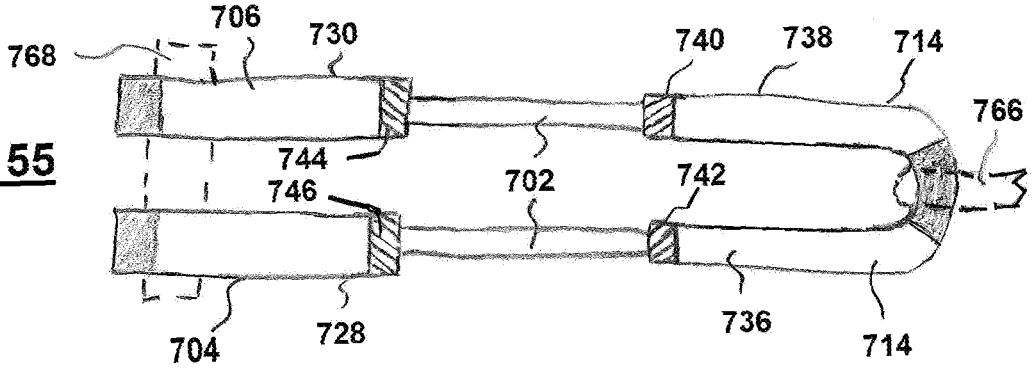
Figure 56:
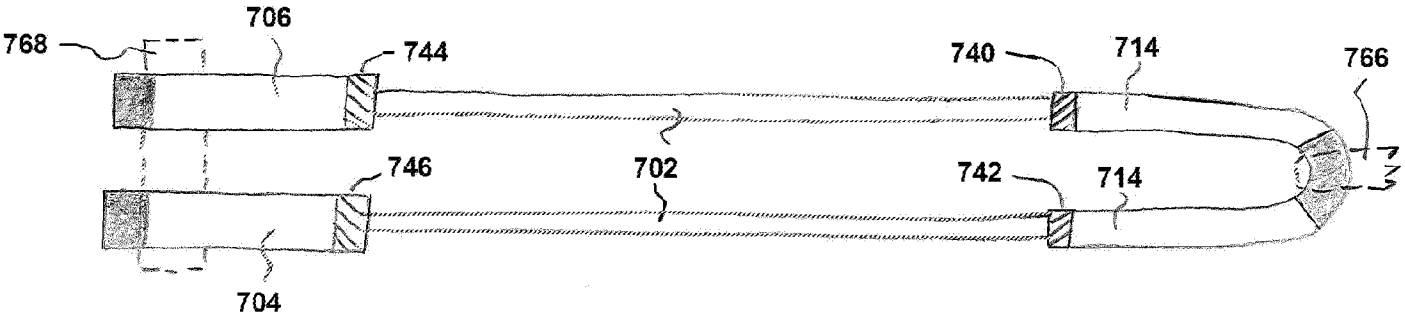

In this described example or other examples, the end portions 724, 726, 728, 730 of the first and second outer jackets 704, 706 may also include visual indicators 744, 746. As the mooring loop stretches farther, the relative distances between the visual indicators 744,746 and the visual indicators 740, 742 (as shown in FIGS. 55 and 56) may be used by mooring personnel to visually gauge how far the mooring loop has stretched.

In addition, the jackets 704, 706, 712, 714 may also have a high visual contrast with respect to the reactive fiber component. For example, the reactive fiber component may be colored (e.g., via a dye, pigment) such that it has a distinctive color (e.g., pink or other color that is a different than the colors of the jackets) that becomes visible when the mooring loop has stretched a sufficient amount (e.g., as shown in FIGS. 54, 55, and 56).

In addition, it should be appreciated that in further example embodiments, other configurations of the jacket(s) around the reactive fiber may be used. For example, rather than having several overlapped jackets, further embodiments may include a single jacket with prepositioned seams that are operative to tear apart and reveal a relatively higher contrast reactive fiber component. It should be understood that the present invention encompasses any type of visual indicator that can be used to provide one or more warnings regarding the initiation of stretching of the mooring loop and/or an amount of stretching of the mooring loop.

In example embodiments, different configurations of the described mooring loop may be produced in specific Effective Load (EL) levels which correspond to Safe Working Loads (SWL) of standard, commercially available ropes regardless of fiber type or constructions. For example, if an SWL level of a 10 cm (4 inch) diameter polypropylene mooring line is 12 tons, then a 12 ton EL level mooring loop should be used to mount the mooring line to a bollard. When a load applied to the mooring line and mooring loop reaches and/or exceeds the EL level of the mooring loop, the reactive fibers are operative to begin stretching. If the load increases above the EL level, the mooring loop will continue to stretch until it reaches a Collapse Load (CL). For example a mooring loop with an EL level of 12 tons may have a CL level 20-40% higher than the EL level (such as a CL level of 16 tons). The CL level also corresponds to a maximum length of stretch of the mooring loop at which the mooring loop breaks. In example embodiments, the CL typically corresponds to a length that is multiples (e.g., greater than 4×, and may be greater than 8×) of the initial length of the mooring loop (when mounted between a mooring line and a bollard). For example, a mooring loop with an EL of 12 tons and a CL of 16 tons may have an amount of reactive fiber operative to enable the mooring loop to stretch an additional 8 feet or longer before it breaks.

In example embodiments, even though an EL level has been reached, a mooring loop may continue to operate safely during at least an initial portion of its elongation. Such an initial portion may correspond to elongation of under 0.9 meters (under 3 feet) for a mooring loop that reaches a CL level at 2.4 meters (8 feet) of elongation. Such an initial portion of elongation corresponds to an Effective Working Range (EWR).

In general, when the mooring loop has stretched less than its EWR (e.g., less than 0.9 meters or 3 feet), the mooring loop may continue to be safely approached by users to add another mooring line to the bollard or take other corrective action to accommodate the load on the mooring lines. However, once the EWR has been surpassed (e.g., the mooring loop has stretched more than 1 meter, then the mooring loop may be considered to be in a danger zone. The sizable elongation of the mooring loop in the danger zone, serves as a visually distinctive warning or alarm regarding the urgency to add another mooring line to a bollard and/or take other actions to reduce the load on the mooring line.

In another example, as described in more detail below, a mooring loop may have a size such that when it is mounted to a bollard with a central diameter of about 23 cm (9 inches), the free standing length of the mooring loop (extending away from the bollard) may be about 46 cm (1.5 feet). In such an example, an amount of reactive fiber may be used in the mooring loop to produce a EWR of about 1.4 meters (4.5 feet) of elongation and a CR level (breaking point) of about 1.8 meters (6 feet) of elongation (after the EWR).

In example embodiments, the previously described visual indicators may be configured on the mooring loop to convey when the mooring loop is in the effective working range (EWR) or in a danger zone. For example, the end portions 732, 734, 736, 738 of the intermediate jackets may begin to be pulled out of the end portions 724, 726, 728, 730 of the outer jackets while the mooring loop is in the effective working range (EWR). In an example embodiment, such end portions 732, 734, 736, 738 of the intermediate jackets may have a different color (e.g., green or yellow) compared to adjacent portions of the intermediate jackets (e.g., grey or white). Thus, when the differently colored end portions become visible (as the mooring loop stretches) such coloring can service as a notification to mooring personnel that the mooring loop is in the effective working range (EWR). In addition, as discussed below in more detail, mooring personnel can monitor the relative distances between the visual indicators 740, 742 and visual indicators 744, 746 to determine when the mooring loop is a danger zone.

In addition, prior to reaching the EL level, the mooring loop may experience only a small percent of elongation (e.g., less than 30 cm or 1 foot) during setting of the line caused by typically short shocks during the mooring process. In an example embodiment, the visual indicators and or different coloring on the end portions 732, 734, 736, 738 of the intermediate jackets 712, 714 may be positioned so as to not become visible until after about at least some amount of stretching of the reactive fiber component in the mooring loop has occurred (e.g., more than 30 cm or 1 foot of elongation).

In example embodiments, little or no stretching initially may occur in the splice of the reactive fiber component. Also, little or no stretching may occur during the effective work range (EWR) of the mooring loop at portions of the mooring loop wound around to bollard. Rather, the reactive fiber component stretches first where the reactive fiber component leaves contact with the bollard. Thus in an example embodiment, the reactive fiber component may be positioned in the jackets such that the splice is substantially aligned in an area of a reinforcing segment (which contacts the bollard or mooring line).

Example 4

A test example of a mooring loop with a construction similar to the mooring loop 700 shown in FIG. 51 was made. For this test example, the reactive fiber component 702 was comprised of a fiber comprised of an un-oriented (undrawn) 4000/144 polypropylene of 4023.2 denier, with 144 filaments, with a denier per filament (DPF) of 28. The fiber was capable of elongation of 1090.7%, (strain at break), and had a tenacity of 1.15 (gf/denier), a finish oil of 0.77% wt, and a resistive force at opening of 2.855 lbf/4000 denier. The reactive fiber component 702 was assembled into a rope with: a yard denier of 44,255 (11 fibers/yarn) and a twist of 1 (TPI); a denier per strand of 2,920,843 (66 yarns/strand); and a denier per rope of 8,762,530 (3 strands/rope).

The four hollow jackets 704, 706, 712, 714 placed around the rope were comprised of a woven polyester. The three reinforcing segments 752, 754, 756, were comprised of a heat shrink rubber tubing. The jackets and reinforcing segments 754, 756 were placed around a 4.3 meter (14 foot) length of reactive fiber rope which was spliced into itself to form a loop. The jackets and reinforcing segments (including the addition of reinforcing segment 752) were arranged as shown in FIG. 51, and the reinforcing segments were heat treated to shrink in size and secure the jacket components in place (as well as to provide wear points for contact with a mooring line and bollard).

Figure 57:
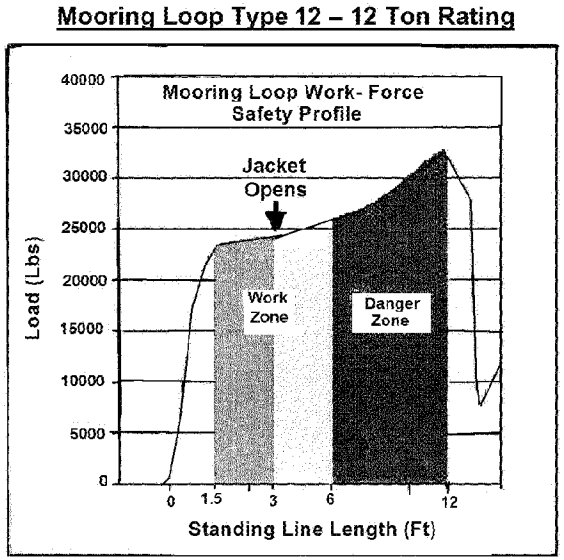
FIG. 57 illustrates an example graph of the amount of resistive force provided by the mooring loop as it is stretched.

FIG. 57 illustrates a graph showing the variation in resistive force provided by the example mooring loop as the mooring loop was stretched over a time period of several minutes from its initial size (in the folded quad configuration shown in FIG. 52) to the point at which the reactive fiber rope broke. As shown in FIG. 57, as the mooring loop was pulled taunt (as illustrated in FIG. 53), the mooring loop provided a resistive force between 0 to about 23,000 lbf (pounds force) for the first 0.5 m (1.5 feet) of elongation. After this initial phase to make the mooring loop taunt, the mooring loop next required a fairly level amount of force (e.g. from about 23,000 lbf to about 26,000 lbf) to stretch the reactive fibers and further elongate the mooring loop an additional 1.4 meters (4.5 feet).

This portion of the stretch of the mooring loop may be regarded as the effective work range (EWR) or work zone and corresponds to the stretch of the mooring loop from FIG. 53 to at least FIG. 55. As illustrated in FIG. 54, in this example, the jackets have sizes such that they begin to separate from each other and expose the reactive fiber component 702 to visibility part way through the EWR. As shown in FIG. 57, this separation of the jackets occurred at an elongation of about 0.5 meters (1.5 feet) (after the start of the EWR) and at a resistive force level of about 24,872 lbf. As the mooring loop stretches further (after FIG. 55) and after elongation beyond the EWR, the mooring loop may be considered to be in the previously described danger zone (such as shown in FIG. 56). Here the amount of resistive force increased more steeply (from about 26,000 lbf to 32,980 lbf), at which point the mooring loop broke after about an additional 1.8 meters (6 feet) of elongation beyond the EWR.

In this example, the jackets were configured such that the indicator feature 740, 742 on the intermediate jackets became visible part way through the EWR (as shown in FIG. 54). When the amount of elongation of the mooring loop approximately doubles from this point, the mooring loop may be considered to within or at least close to its danger zone. Thus mooring personnel may be able to recognize that the mooring loop is in or is at least close to being in its danger zone by visually observing that the indicator features 744, 746 on the outer jackets 704, 706 are (as shown in FIG. 55) about halfway between the bollard 768 end of the mooring loop and the visual indicators 740, 742 on the intermediate jackets 712, 714. Also, as shown in FIG. 56, when the indicator features 744, 746 on the outer jackets 704, 706 are significantly less than half way between the bollard end of the mooring loop and the visually indicators 740, 742 on the intermediate jackets 712, 714, the mooring personnel can clearly determine that the mooring loop is in the danger zone.

In this example, the increase in resistive force (i.e., strength) of the mooring loop in the danger zone may be sufficient to stop and/or at least slow the stretch of the mooring loop until corrective action can be taken. However, it should be appreciated that when the mooring loop is in the danger zone, immediate corrective actions should be taken to prevent the mooring line from breaking way from the bollard.

The previously described example is one possible construction for the embodiments described herein. It should be appreciated that alternative examples may have other types, sizes, lengths, configurations, and amounts of reactive fiber and other components to serve different strengths of mooring lines and applications.

It follows that the securing device of the example embodiments achieve at least some of the above stated objectives, eliminate difficulties encountered in the use of prior devices and systems, and attain the useful results described herein.

In the foregoing description, certain terms have been described as example embodiments for purposes of brevity, clarity and understanding. However, no unnecessary limitations are to be implied therefrom, because such terms are used for descriptive purposes and are intended to be broadly construed. Moreover, the descriptions and illustrations herein are by way of examples, and the invention is not limited to the features shown or described.

Further, in the following claims any feature described as a means for performing a function shall be construed as encompassing any means known to those skilled in the art as being capable of carrying out the recited function and shall not be deemed limited to the particular means shown or described for performing the recited function in the foregoing description, or mere equivalents thereof.

Having described the features, discoveries and principles of the invention, the manner in which it is constructed and operated, any of the advantages and useful results attained; the new and useful structures, devices, elements, arrangements, parts, combinations, systems, equipment, operations, methods, processes and relationships are set forth in the appended claims.

The invention claimed is:

1. An apparatus comprising:

a mooring loop including:

a reactive fiber component in the shape of a continuous loop, wherein the reactive fiber component includes a plurality of at least one of: an undrawn hydrophobic polymer fiber, a substantially undrawn hydrophobic polymer fiber or any combination thereof, wherein the reactive fiber component is operative to stretch responsive to a load; and at least two jackets in surrounding relation around the reactive fiber component, wherein the at least two jackets include respective end portions, wherein an end portion of one of the jackets is in surrounding relation around an end portion of an adjacent jacket, wherein at least some portions of the reactive fiber component are operative to stretch responsive to a load and cause the end portions of the at least two jackets to pull away from each other.

2. The apparatus according to claim 1, wherein the mooring loop includes a plurality of reinforcing segments in surrounding relation around the jackets.

3. The apparatus according to claim 2, wherein at least one jacket corresponds to an intermediate jacket with an end portion positioned inside an end portion of one other jacket that corresponds to an outer jacket, wherein the end portion of the intermediate jacket includes a visual indicator having a visual appearance with at least one color that is different than a visual appearance of portions of the end portion of the intermediate jacket that are adjacent to the visual indicator.

4. The apparatus according to claim 3, wherein the visual appearance of the portions of the end portion of the jacket that are adjacent to the visual indicator is a different color than a visual appearance of portions of the intermediate jacket positioned outside the outer jacket.

5. The apparatus according to claim 3, wherein the visual indicator includes a band in surrounding relation to the end portion of the intermediate jacket.

6. The apparatus according to claim 2, further comprising an intermediate reinforcing segment in surrounding relation to an intermediate portion of the mooring loop which separates two opposed apertures through the mooring loop on opposed sides of the intermediate reinforcing segment.

7. The apparatus according to claim 6, wherein the mooring loop has a shape of a figure eight when in an extended orientation.

8. The apparatus according to claim 7, further comprising a bollard and a mooring line, wherein the mooring loop is in operative connection between the mooring line and the bollard.

9. The apparatus according to claim 8, wherein the opposed apertures of the mooring loop are positioned to extend around the bollard, and the mooring line is positioned to extend around the intermediate reinforcing segment.

10. The apparatus according to claim 6, wherein the mooring loop includes two outer jackets positioned around opposed ends of the reactive fiber component and includes two intermediate jackets positioned around intermediate portions of the reactive fiber component between the opposed ends, wherein each of the intermediate jackets includes end portions, wherein each of the outer jackets includes end portions, and wherein the end portions of each of the intermediate jackets extend inside adjacent end portions of the outer jackets.

11. The apparatus according to claim 10, wherein each of the end portions of the intermediate jackets includes a visual indicator.

12. The apparatus according to claim 11, wherein the intermediate reinforcing segment extends in surrounding relation around the two intermediate jackets.

13. The apparatus according to claim 12, wherein the mooring loop includes two end reinforcing segments, wherein the two end reinforcing segments are respectively in surrounding relation to the respective outer jackets.

14. The apparatus according to claim 13, wherein the reactive fiber component includes a plurality of polypropylene fibers configured into a rope.

15. The apparatus according to claim 14, wherein the plurality of jackets are comprised of a woven polyester.

16. The apparatus according to claim 15, wherein the reinforcing segments are comprised of a rubber that is heat shrunk to hold the jackets in place.

17. The apparatus according to claim 15, wherein the rope includes three strands that are spliced together to form the continuous loop, wherein the position of the splice is inside one of the reinforcing segments.

18. The apparatus according to claim 10, wherein at least some portions of the reactive fiber component are operative to stretch at least 4 times greater in length, wherein as the reactive fiber component stretches, the end portions of the intermediate jackets are operative to pull out of and away from the end portions of the outer jackets.

19. The apparatus according to claim 18, wherein at the point of stretch of the reactive fiber component where the intermediate jackets initially pulls out of and away from the end portions of the outer jackets, the reactive fiber component provides a resistance force of at least 20,000 lbf to further stretching of the reactive fiber component.

20. An apparatus comprising:

a mooring loop including:

a reactive fiber component spliced together into a shape of a continuous loop, wherein the reactive fiber component includes a plurality of at least one of: an undrawn hydrophobic polymer fiber, a substantially undrawn hydrophobic polymer fiber or any combination thereof, wherein the reactive fiber component is operative to stretch responsive to a load;

at least one jacket in surrounding relation around the reactive fiber component, wherein at least some portions of the reactive fiber component are operative responsive to a load to enable the mooring loop to stretch multiple times greater in length, wherein as at least portions of the reactive fiber component stretch, at least one portion of the at least one jacket is operative to become separated and enable portions of the reactive fiber component to become visible; and an intermediate reinforcing segment in surrounding relation to an intermediate portion of the mooring loop which separates two opposed apertures through the mooring loop on opposed sides of the intermediate reinforcing segment.

* * * * *